United States Patent [19]

Roy

[11] B 4,052,954

[45] Oct. 11, 1977

[54] PUSH BUTTON SWITCH MODE INDICATOR ELEMENT

[75] Inventor: Kenneth Lee Roy, Menomonee Falls, Wis.

[73] Assignee: Globe-Union Inc., Milwaukee, Wis.

[21] Appl. No.: 469,228

[22] Filed: May 13, 1974

[44] Published under first Trial Voluntary Protest Program on Feb. 17, 1976 as document No. B469,228

[51] Int. Cl.[2] ..... G09F 9/00; H01H 9/16

[52] U.S. Cl. ..... 116/124 L; 200/308

[58] Field of Search ..... 116/124 R, 124 L, DIG. 28, 116/135, 172; 200/308, 314, 340, 309, 167 R, 167 A

[56] References Cited

U.S. PATENT DOCUMENTS

| | | | |
|---|---|---|---|
| 513,705 | 1/1894 | Busby | 116/172 |
| 2,293,752 | 8/1942 | O'Brien | 200/340 X |
| 2,447,453 | 8/1948 | Zehnpfennig | 200/340 X |
| 3,250,887 | 5/1966 | Sorenson | 200/308 |
| 3,375,337 | 3/1968 | Barrett et al. | 200/308 X |
| 3,576,175 | 4/1971 | Cammill | 116/124 L |
| 3,715,548 | 2/1973 | Schadow | 116/124 X |
| 3,769,482 | 10/1973 | New et al. | 200/167 R |
| 3,845,736 | 11/1974 | Golbeck | 116/124 R |
| 3,855,959 | 12/1974 | Hinze | 200/167 A X |
| 3,855,961 | 12/1974 | Schadow | 200/167 A X |

FOREIGN PATENT DOCUMENTS

| | | | |
|---|---|---|---|
| 2,020,084 | 11/1970 | Germany | 116/124 L |

OTHER PUBLICATIONS

Publication: "Modular Push Button Switches," "Creative Switchmeters," Schadow IEE Corp., Minnesota. See p. 10 of Amendment filed Sept. 7, 1976.

*Primary Examiner*—Richard C. Queisser
*Assistant Examiner*—Daniel M. Yasich
*Attorney, Agent, or Firm*—James L. Kirschnik; John Phillip Ryan

[57] ABSTRACT

A position or mode indicator for a slider mechanism and particularly a slider forming a part of a push button switch. A button type housing is externally fitted to a push button switch and encloses a rotatable member which is secured in the housing in back of a clear lens. Mode indicating means are carried by the rotatable member and actuator means are supported from the body of the push button switch. The actuator means is interconnected with the rotatable member and movement of the button housing effects movement of the rotatable member by means of the actuator means.

2 Claims, 10 Drawing Figures

FIG. 1.
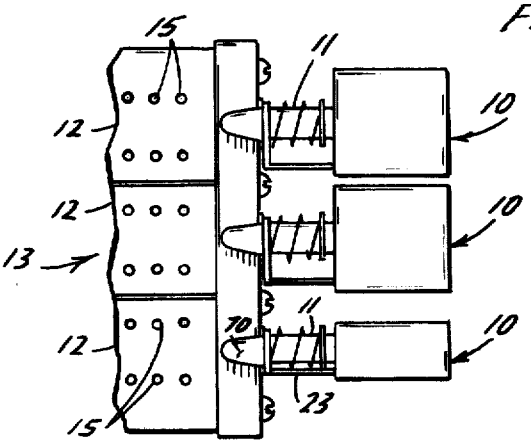
FIG. 2.
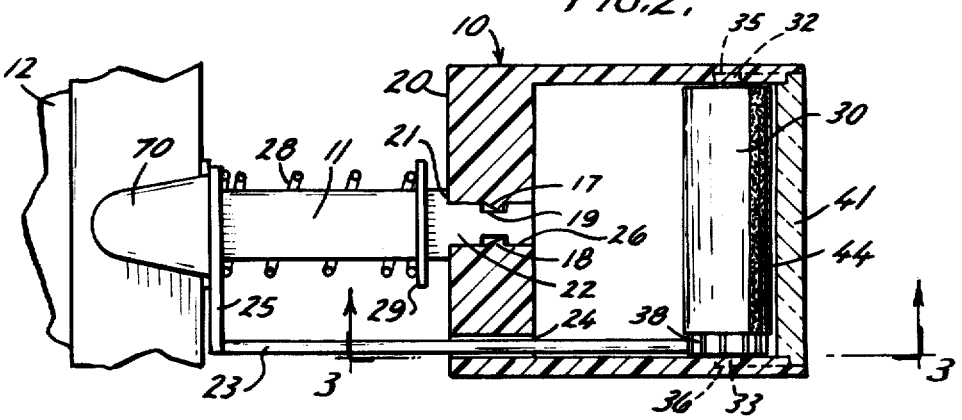
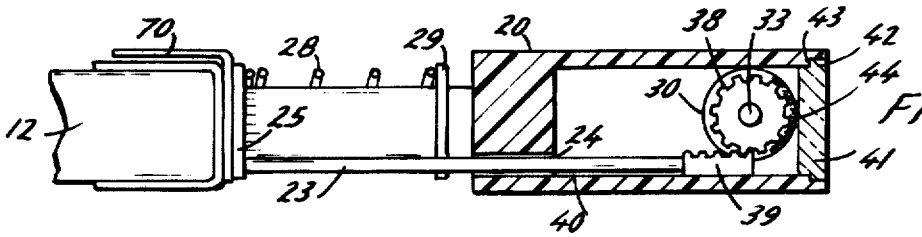
FIG. 3.
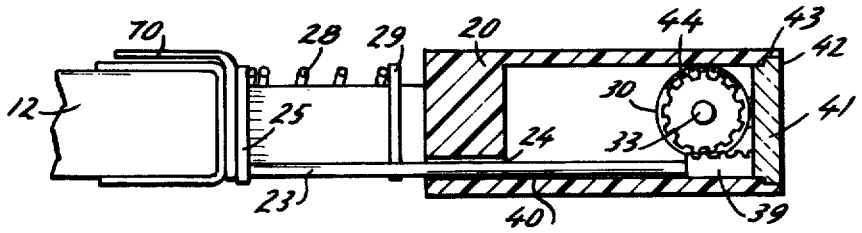
FIG. 4.

PUSH BUTTON SWITCH MODE INDICATOR ELEMENT

BACKGROUND OF THE INVENTION

This invention relates to mode or position indicating means for a slider element. More particularly, it relates to a mode indicator for a push button switch wherein a rotatable member is rotatably secured in a housing element. Actuator means are supported from a push button switch body and are interconnected to the rotatable member. Mode indicating means are carried by the rotatable member. Movement of the housing element with the slider effects movement of the rotatable member and the mode indicating means.

In the manufacture of push button switches, it is desirable to have the position or mode of the switch indicated. This gives an immediate determination of the circuitry controlled by the switches. Many such mode indicators, such as described in U.S. Pat. No. 3,691,985, employ a light which is designed to illuminate a portion of the switch. Such lighted mode indicators are expensive to manufacture as they require special internal fabrication in the switch body, do not provide a fail-safe feature when the bulb burns out and require a changing of the bulb. Recently, as described in U.S. Pat. 3,715,548, attempts have been made to eliminate lighted mode indicators for push button switches and to utilize a mode indicator which could be externally attached to a finished switch. However, such devices require the fabrication and movement of numerous parts. Consequently, they are subject to malfunction, do not have a long operative life and are costly. Other units, as illustrated in U.S. Pat. No. 3,237,591, do not effect an absolute on-off condition.

It is an object of the present invention to provide a mode or position indicator for a slider element which is easily and economically fabricated. It is another object of the present invention to provide a mode indicator for a push button switch which is easily attached to a finalized switch unit. It is still another object of this invention to provide a mode indicator for a push button switch which will afford positive identification of the switch mode. It is yet another object of this invention to afford a push button switch mode indicator which will permit a wide variety of colors or legends to be placed in or on the mode indicating means.

SUMMARY OF THE INVENTION

The foregoing objects are accomplished and the shortcomings of the prior art are overcome by the present mode indicator wherein a movable housing element is adapted to be friction fitted on the slider element of a push button switch. A lens is disposed in the housing element opposite the contact with the slider. A rotatable member is mounted in said housing element for movement with the housing and extends across the entire area of the lens inside the housing. Mode indicating indicia are carried by the rotatable member. Actuator means are supported from the switch body and are interconnected with the rotatable member so that movement of the housing element effects movement of the slider element and the rotatable member with the mode indicating indicia.

BRIEF DESCRIPTION OF DRAWINGS

A better understanding of the present mode indicator will be afforded by reference to the drawings wherein:

FIG. 1 is a top plan view illustrating one embodiment of the invention in operative engagement with and in different positions on three modular switch elements.

FIG. 2 is an enlarged view in horizontal section illustrating one of the mode indicator buttons in FIG. 1 mounted parallel to the switch housing and illustrating the various components inside of the body of the mode indicating button.

FIG. 3 is a view in vertical section taken along line 3—3 of FIG. 2.

FIG. 4 is a view similar to FIG. 3 except showing the mode indicator button in a different position.

DESCRIPTION OF THE EMBODIMENTS

Figure 5:
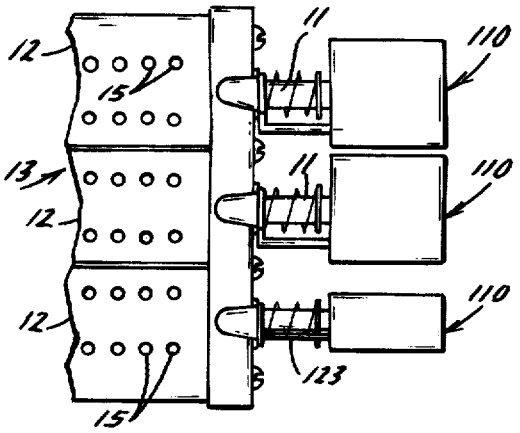
FIG. 5 is a view similar to FIG. 1 except showing an alternative embodiment of the invention in operative engagement on a three modular switch element.

Proceeding to a description of the present invention, one embodiment of the mode indicating button is indicated generally by the numeral 10 and is attached to the usual slider element 11 mounted in a push button switch body 12. Slider element 11 and push button switch body or stator block 12 with slider element 11 compose the usual push button switch generally 13. As the mode indicator of this invention is operable by any type of push-push type switching mechanism, only a brief description of the push button switch is necessary. Switch 13 has, as previously stated, the usual stator block 12 with fixed contact terminals 15. Moveable contacts (not shown) internally engage fixed contact terminals 15 in the stator block 12.

As shown in FIG. 2, mode indicating button 10 is attached to slider 11 by means of barbed flanges 17 and 18 engaging annular groove 19 of slider 11. To aid in the secure attachment, housing 20 will abut against a shoulder portion 21 on slider 11. A bar member 23 is disposed parallel with slider 11 and extends through an opening 24 in button housing 20. Member 23 has a leg portion 25 secured over leaf spring 70 by means of coil spring 28 which is retained on slider 11 by means of the usual retaining clip 29. A rotatable member 30 is pivotally disposed in housing 20 by means of shafts 32 and 33 engaging bearing compartments 35 and 36, respectively. Secured in a fixed manner on the shaft 33 of rotatable member 30 is a pinion 38 for operative engagement with rack 39 secured to the end of bar 23. As is best seen in FIGS. 3 and 4 rack 39 slides over and is supported by the inside surface 40 of housing 20. It is guided by bar 23 extending through slotted opening 24. A lens 41 is carried by housing 20 opposite its engagement with slider 11 and is frictionally fixed therein by means of flange 42 engaging shoulder 43 of the housing member 20.

Referring to the embodiment disclosed in FIGS. 5–8, similar numbers are employed to designate similar parts except they are in the "100" series.

Figure 6:
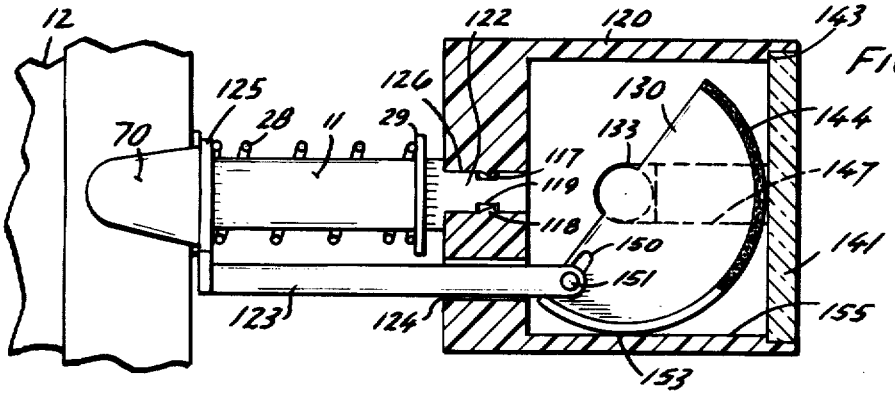
FIG. 6 is an enlarged view in a horizontal section illustrating one of the mode indicator buttons shown in FIG. 5 and mounted parallel to the switch housing illustrating the various components inside the body of the mode indicating button.
Figure 7:
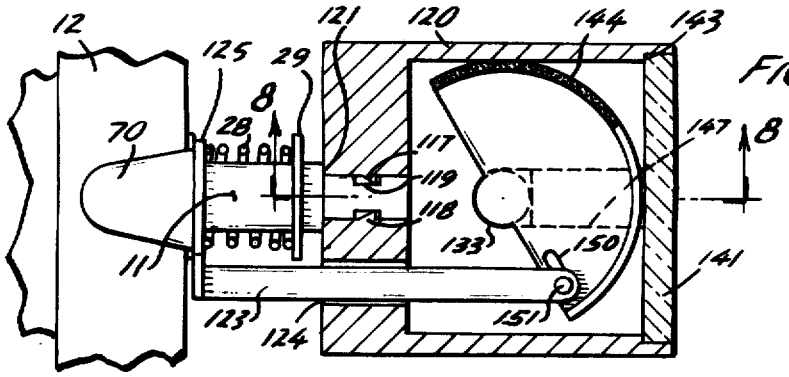
FIG. 7 is a view similar to FIG. 6 except showing the mode indicating button in a different position.
Figure 8:
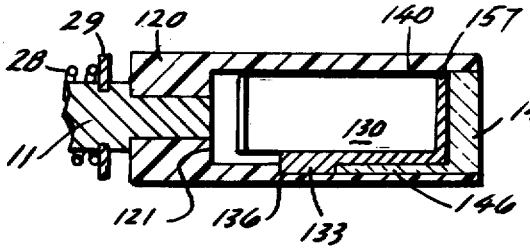
FIG. 8 is a view in vertical section taken along line 8—8 of FIG. 7.

It will be seen in FIG. 5 that mode indicator button 110 is utilized on the same type of push button switch body 12 as is mode indicating button 10. The basic difference between mode indicator button 10 and 110 is in the rotatable member 130 which unlike rotatable member 30 is not in a complete cylindrical form but, as best shown in FIGS. 6–8, is defined by a semicylindrical member which is L-shaped in cross-section. Rotatable member 130 is pivotally secured in housing 120 by means of hub 133 rotatably mounted in compartment 136 of housing 120. A slot 147 extends outwardly from compartment 136 and accommodates a leg portion or extention 146 of lens 141 to secure hub 133 in and form a compartment for bearing compartment 136. Rotatable member 130 is actuated inside of housing 120 by means of bar member 123 which is slidably attached to rotatable member 130 by means of retaining slide pin 151 which secures bar 123 for slidable movement along slot 150. It will be seen that rotatable member 130 is designed to be guided inside housing 120 by means of slight engagement 153 with the inside wall surfaces 140 and 155 when in the downward or upper positions as shown in FIGS. 6 and 7 and by slightly contacting the inside surface of lens 141 as shown in both of these FIGURES.

Figure 9:
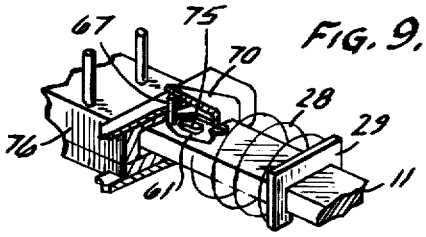
FIG. 9 is a view in partial section illustrating the push-push mechanism of the push button switches shown in FIGS. 1–8.
Figure 10:
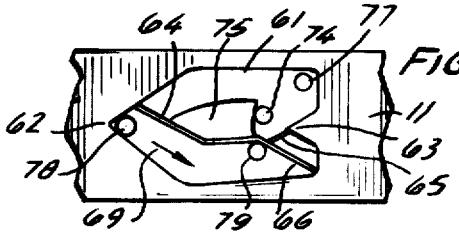
FIG. 10 is a partial view of the cam operating mechanism which is utilized in the push-push mechanism shown in FIG. 9.

One means for effecting a push-push operation of slider element 11 is disclosed in FIGS. 9 and 10. This particular mechanism is the subject matter of U.S. Pat. No. 3,229,548. As explained in that patent, slider element 11 incorporates a hollow cam notch 61 with a closed contour, either symmetrical or asymmetrical, having two points or peaks 62 and 63. The depth of cam notch 61 is variable to form several bevels and stops 64, 65, and 66 which causes a retaining finger or pin 67 to move along the guiding profile always in the direction of arrow 69. The retaining pin is formed by a simple pin which is elastically held against the bottom of the cam notch by leaf spring 70. A brief description of the operation of the camming mechanism is as follows: When the slider element 11 is in a depressed position which effects a compression of spring 28, the end of the pin 67 is in the position 74 in the cam notch 61. This holds the slider bar in this position against the force of spring 28 by engaging in the notched part of the central bar 75 which is located opposite the point or peak 63 of the heart cam. In this position, the pin 67 is braced against the edges of a retaining opening, (not shown) in frame 76. When the slider element 11 is depressed, the end of pin 67 is prevented from returning backward by the bevel 63 and therefore moves in the direction of the arrow 69 towards the position 77. When the slider element 11 is released it will move backward under the influence of spring 28 which causes the end of pin 67 to follow the whole upper branch of cam notch 61 and lodge in the depression formed by the peak 62 and at position 78, which determines the second position of the slider element. When the slider element 11 is again depressed, the pin 67 will ride downwardly through the slope of bevel 64 to position 79 and ultimately to position 74 through bevels and stops 66 and 63.

OPERATION

A better understanding of the advantages of the mode indicating buttons 10 and 110 in this invention will be had by a description of their operation and assembly. As both mode indicating buttons 10 and 110 are assembled and operate in essentially the same manner, only the descriptive operation for mode indicating button 10 will be described except for the differences relating to mode indicating button 110. Rack 39 with bar 23 will be inserted through opening 24 of housing 20 and positioned as shown in FIG. 3. With lens 41 removed, rotatable member 30 will be rotatably positioned in housing 20 by means of shafts 32 and 33 engaging bearing compartments 35 and 36 which will place the teeth of pinion 38 in engagement with the teeth of rack 39. Lens 41 will next be snap fitted into place in housing 20 by means of shoulder 43 and flange 42. When it is desired to place mode indicator button 10 on a slider 11 of a push button switch 13 all that is required is to position leg portion 25 of bar support member 23 on top of leaf spring 70 with coil spring 28 placed thereover. Simultaneously, the narrowed portion 22 of slider 11 is placed in opening 26 of housing 20 so that barbed flanges 17 and 18 engage slider groove 19 of slider 11 and housing 20 abuts against shoulder 21.

With button 10 engaging slider 11 and slider member 11 in the decompressed state, the rotatable member 30 will be in a position as indicated in FIG. 3. In this manner the black portion or mode indicating indicia 44 will be viewed through lens 41 which will indicate a decompressed position. When it is desired to change the mode of the switch and to move slider 11 inwardly into stator block 12, body 20 is pressed across lens 41 which will cause with the movement of slider 11, movement of button body 20 toward stator block 12. This will effect a corresponding counterclockwise movement of rotatable member 30 by pinion 38 moving over stationary rack 39 as the rack rides along the inside wall surface 40 of button body 20 to position mode indicating indicia 44 substantially out of view of lens 41 as shown in FIG. 4. This movement is continued until pin 67 of the push-push mechanism will engage peak 63 of cam notch 61 and come to rest at position 74. The movement of the indicia 44 out of view of lens 41 in this position will indicate that the switch is now activated. When the slider bar and switch are decompressed, by a subsequent pushing and release action, housing 20 will move away from stator block 12 and backwardly along bar member 23. At the same time, movement of lens 41 away from rack 39 will be effected to cause a consequent clockwise movement of pinion 38 over stationary rack 39 as viewed in FIG. 3 to effect movement of rotatable member 30 back to its original position as shown in FIG. 3.

The assembly and operation of mode indicator button 110 is essentially the same as that for 10 except that, with lens 141 removed, bar member 123 would be attached to rotatable member 130 by inserting the retaining pin 151 through slot 150. Hub 133 would then be inserted in bearing compartment 136 and leg portion 146 of lens 141 would then be inserted in slot 147 to secure hub 136 in body portion 120 and to prevent its removal during movement of body portion 120 toward switch 13. During such movement, mode indicating indicia 144 would be moved from a position of being viewed behind lens 141 as shown in FIG. 6 to a position where it would not be substantially viewed as indicated in FIG. 7. This change of position of rotatable member 130 is effected by means of stationary bar member 123 retentively sliding in slot 150 as housing 120 is moved toward and away from stator block 12 as indicated in FIGS. 6 and 7. Rotatable member 130 will be guided inside housing 120 by means of its slight engagement by portions of its wall surfaces such as 153 contacting slightly adjacent portions, such as 155, of the inside wall surfaces of housing 120. This is indicated in FIG. 6 and particularly FIG. 8 where the end surface 157 of the rotatable member 130 opposite to hub 133 rests against the inside wall 140 of housing 120.

Mode indicating buttons 10 and 110 have been described for use with the slider 11 on a push button switch 13. Mode indicating buttons 10 and 110 could be used to advantage on any type of slider element with a temporary retention feature such as a retractable ball pen or pencil. All of the components of the mode indicating button 10 and 110 are fabricated from resinous plastic. The preferred plastic material is acrylonitrilebutadiene-styrene. However, others such as platable thermoplastics as supplied under the trade name Noryl by General Electric Company, nylon, etc. could be utilized.

In the preferred embodiment of the invention, the rotatable members 30 and 130 are illustrated with darkened sections 44 and 144. If desired, numerical designations or wording could be placed in this area with the remaining portion of the rotatable members when viewed in the second position being either blank or containing other wording or other colors. Obviously, various combinations of black or color could be substituted for the mode indicating indicia portion 44 and 144 and the remaining portions of the rotatable members 10 and 110.

It will thus be seen that through the present invention there is now provided a mode indicating means for a push-slider mechanism which employs a minimum number of parts and is actuated without requiring complex mechanical engagement of the parts. The mode indicating means of this invention eliminates the need for any illumination source while at the same time providing a wide variety of indicia on the mode indicating means. The mode indicator button is quickly mounted on a push button switch and is adapted easily to be mounted in various accommodating positions. The mode indicating means can be fabricated independent of the push button switch to which it is ultimately connected and can be done in an economical and rapid manner without requirement for close tolerances.

The foregoing invention can now be practiced by those skilled in the art. Such skilled persons will know that the invention is not necessarily restricted to the particular embodiments herein. The scope of the invention is to be defined by terms of the following claims as given meaning by the preceeding description.

I claim:

1. A mode indicating device for a pushbutton switch, said switch having a body and a reciprocating slider moveable between a first position in which said switch is in one mode and a second position in which said switch is in a second mode, said indicating device comprising:

a lens having a leg portion extending therefrom;

a hollow housing attached to said slider, said housing having an opening receiving said lens in one end, an aperture at the opposite end, a bearing compartment disposed on a wall of said hollow housing, and a slot extending from said bearing compartment to said one end of said housing, said lens leg portion forming a wall of said bearing compartment;

a mode indicator rotatably mounted within said housing adjacent the interior of said lens, said indicator being rotatable about an element having an axis which is fixed relative to said housing, said element extending transverse to the direction of movement of said slider between opposed walls of said housing and having a shaft portion thereof disposed in said slot in said bearing compartment and adjacent said lens leg portion, said mode indicator having a rounded surface formed about said fixed axis and having mode indicating indicia formed thereon; and actuator means having one end coupled to said switch body and the other end extending through said aperture and means pivotally coupled to said mode indicator for pivoting said indicator in response to movement of said slider and housing to position said indicia adjacent said lens when said switch is in said second mode.

2. The mode indicating device as defined in claim 1 wherein said rounded surface is semi-cylindrical.

3. The mode indicating device as defined in claim 2 wherein said actuator means comprises a bar member pivotally attached to said mode indicator, and said actuator means slidably extending through said aperture formed in said housing.

4. The mode indicating device as defined in claim 1 wherein said rounded surface is cylindrical.

5. The mode indicating device as defined in claim 4 wherein said actuator means comprises a bar member having a rack and said mode indicator has a pinion operatively engaged by said rack.

6. The mode indicating device as defined in claim 5 wherein said bar member and said rack are constructed in a unitary manner and arranged to ride over an inside wall surface of said housing element.

7. The mode indicating device as defined in claim 6 wherein said housing includes a wall portion with an opening for guiding said bar member.

* * * * *